US009861134B2

(12) United States Patent
Zhu

(10) Patent No.: US 9,861,134 B2
(45) Date of Patent: Jan. 9, 2018

(54) HEATING ASSEMBLY FOR ELECTRONIC CIGARETTE VAPORIZER

(71) Applicant: Xiaochun Zhu, Guangdong (CN)

(72) Inventor: Xiaochun Zhu, Guangdong (CN)

( * ) Notice: Subject to any disclaimer, the term of this patent is extended or adjusted under 35 U.S.C. 154(b) by 523 days.

(21) Appl. No.: 14/605,755

(22) Filed: Jan. 26, 2015

(65) Prior Publication Data

US 2016/0143358 A1 May 26, 2016

Related U.S. Application Data

(63) Continuation of application No. PCT/CN2014/092193, filed on Nov. 25, 2014.

(51) Int. Cl.

| | |
|---|---|
| ***H05B 3/03*** | (2006.01) |
| ***A24F 47/00*** | (2006.01) |
| ***H05B 3/24*** | (2006.01) |

(52) U.S. Cl.

CPC ..... *A24F 47/008* (2013.01); *H05B 3/24* (2013.01); *H05B 2203/003* (2013.01); *H05B 2203/014* (2013.01)

(58) Field of Classification Search

None

See application file for complete search history.

(56) References Cited

U.S. PATENT DOCUMENTS

2017/0150755 A1* 6/2017 Batista ..... A24F 47/008

* cited by examiner

*Primary Examiner* — Michael J Felton
*Assistant Examiner* — Katherine Will
(74) *Attorney, Agent, or Firm* — Locke Lord LLP; Tim Tingkang Xia, Esq.

(57) ABSTRACT

Certain aspects of the present invention relate to a heating assembly for electronic cigarette vaporizer. In certain embodiments, heating assembly includes: a pair of vaporizer shields, certain heating elements, an e-liquid medium, a pair of vapor guides, and a vaporizing chamber side cover. Vaporizer shields are disposed on a heating element base. An e-liquid medium opening is defined between the vaporizer shields. Each of the heating elements has a first terminal and a second terminal. The e-liquid medium is vertically positioned in the e-liquid medium opening. The e-liquid medium has certain heating element grooves for installing the heating elements. The vapor guides are placed between vaporizer shields and the e-liquid medium. The vaporizing chamber side cover is configured to surround the first vaporizer shield and the second vaporizer shield, the e-liquid medium. The vaporizing chamber side cover defines two e-liquid conduit openings, one on each side of the e-liquid medium.

20 Claims, 4 Drawing Sheets

HEATING ASSEMBLY FOR ELECTRONIC CIGARETTE VAPORIZER

CROSS-REFERENCE TO RELATED APPLICATIONS

This application is a continuation application of a PCT/CN2014/092193, filed with the State Intellectual Property Office of China on Nov. 25, 2014, entitled "HEATING ASSEMBLY FOR ELECTRONIC CIGARETTE VAPORIZER", by Xiaochun ZHU, the disclosure of which is incorporated herein in their entireties by reference.

FIELD

The present invention generally relates to the field of electronic cigarette (or e-cigarette), and more particularly to a heating assembly for electronic cigarette vaporizer.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

It is well known that smoking cigarette is harmful to smoker's health. The active ingredient in a cigarette is mainly nicotine. During smoking, nicotine, along with tar aerosol droplets produced in the cigarette burning, are breathed into the alveolus and absorbed quickly by the smoker. Once nicotine is absorbed into the blood of the smoker, nicotine then produces its effect on the receptors of the smoker's central nervous system, causing the smoker relax and enjoy an inebriety similar to that produced by an exhilarant.

The electronic cigarette is sometimes referred as electronic vaporing device, personal vaporizer (PV), or electronic nicotine delivery system (ENDS). It is a battery-powered device which simulates tobacco smoking. It generally uses a heating element that vaporizes a liquid solution (e-liquid). Some solutions contain a mixture of nicotine and a variety of flavorings, while others release a flavored vapor without nicotine. Many are designed to simulate smoking experience, such as cigarette smoking or cigar smoking Some of them are made with similar appearance, while others are made considerably different in appearance.

Conventional electronic cigarettes are made with a mouth piece assembly, a vaporizer assembly, an electric connecting assembly, and an e-liquid storage assembly. The mouth piece is installed on top of the e-liquid storage assembly, and the vaporizer assembly is installed inside of the e-liquid storage assembly, and electrically connected to a DC power source through the electric connecting assembly. The mouth piece assembly is connected to the vaporizer assembly and forms an air flow passage. The e-liquid is stored in the e-liquid storage assembly. The e-liquid flows through a vaporizing chamber of the heating assembly using fiber threads. The e-liquid in the fiber threads is then heated by a heating wire of the heating assembly and therefore vaporized. The vaporized e-liquid goes up to the mouth piece such that a smoker enjoys the vaporized e-liquid. However, the vapor flow and the quantity and speed of e-liquid vaporization are not controllable or adjustable to meet the different demands of various electronic cigarette smokers.

Therefore, an unaddressed need exists in the art to address the aforementioned deficiencies and inadequacies.

SUMMARY

In one aspect, the present invention relates to a heating assembly for electronic cigarette vaporizer. In certain embodiments, the heating assembly includes: a pair of vaporizer shields, certain heating elements, an e-liquid medium, a pair of vapor guides, and a vaporizing chamber side cover. The pair of vaporizer shields includes a first vaporizer shield on a first side, and a second vaporizer shield on an opposite, second side, disposed on a heating element base. An e-liquid medium opening is defined between the first vaporizer shield and the second vaporizer shield at both ends of the first vaporizer shield and the second vaporizer shield. Each of the heating elements has a first terminal and a second terminal. The e-liquid medium is vertically positioned in the e-liquid medium opening between the first vaporizer shield and the second vaporizer shield. The e-liquid medium has certain heating element grooves for installing the heating elements. The pair of vapor guides includes a first vapor guide positioned between the first vaporizer shield and the e-liquid medium, and a second vapor guide positioned between the second vaporizer shield and the e-liquid medium. The vaporizing chamber side cover is configured to surround the first vaporizer shield and the second vaporizer shield, the e-liquid medium. The vaporizing chamber side cover defines a first e-liquid conduit opening on a first side, adjacent to and in communication with a first end of the e-liquid medium, and a second e-liquid conduit opening on an opposite, second side, adjacent to and in communication with an opposite, second end of the e-liquid medium.

In certain embodiments, the first vaporizer shield and the second vaporizer shield form a round vaporizing chamber having a vaporizing chamber air intake at a lower end of the vaporizing chamber and a vaporizing chamber air discharge at an upper end of the vaporizing chamber, and each of the first vaporizer shield and the second vaporizer shield defines a vapor guide connecting opening.

In certain embodiments, the e-liquid medium opening has an upper end at the vaporizing chamber air discharge and a lower end at the vaporizing chamber air intake. The outer perimeter of the first vaporizer shield and the second vaporizer shield is substantially square to fit inside of the vaporizing chamber side cover.

In certain embodiments, the first vapor guide has a round portion on a first side fitting to the round vaporizing chamber and a straight portion on an opposite side facing the e-liquid medium, and the second vapor guide has a round portion on a first side fitting to the round portion of the vaporizing chamber and a straight portion on an opposite side facing the e-liquid medium. The round portion of the first vapor guide has a first vapor guide connector configured to connect to the vapor guide connecting opening of the first vaporizer shield. The round portion of the second vapor guide also has a second vapor guide connector configured to connect to the vapor guide connecting opening of the second vaporizer shield. The straight portion of each of the first and the second vapor guides has a vapor guide bulge which is configured to guide the air from the vaporizing chamber air intake to the e-liquid medium.

In certain embodiments, the first vapor guide connector fits into the vapor guide connecting opening of the first vaporizer shield and the second vapor guide connector fits into the vapor guide connecting opening of the second vaporizer shield. The shapes of first vapor guide connector and the second vapor guide connector include: a round shape, an oval shape, a square shape, a rectangle shape, and a polygon shape. Each of the first e-liquid conduit opening and the second e-liquid conduit opening is substantially in the shape and size of the e-liquid medium opening configured to fully expose e-liquid from an e-liquid storage to flow into the e-liquid medium.

In certain embodiments, each of the heating elements includes a heating wire. The heating has the first terminal for electrically connecting to the first terminal of the electric ire power supply, and the second terminal for electrically connecting to the second terminal of the electric power supply. The heating wire is wound into a flat surface in a shape of: a spiral, a parabolic spiral, a round, an oval, a polygon, a rectangle, and a square.

In certain embodiments, each of the first e-liquid conduit opening and the second e-liquid conduit opening is in the shape and size of the e-liquid medium opening configured to fully expose e-liquid from an e-liquid storage to flow into the e-liquid medium.

In certain embodiments, the e-liquid medium includes one of following materials: cotton fibers, polypropylene fibers, terylene fibers, nylon fibers, and various porous ceramic materials. In one embodiment, the e-liquid medium includes two heating element grooves: a first heating element groove for installing a first heating element, and a second heating element groove for installing a second heating element. The e-liquid medium is divided into three portions: a first portion defined between a first side of the e-liquid medium and the first heating element groove, a second portion defined between the first heating element groove and the second heating element groove, and a third portion defined between the second heating element groove and a second side of the e-liquid medium. Each of the first portion of the e-liquid medium and the third portion of the e-liquid medium includes a vaporizing window configured to expose vaporized e-liquid to a vapor chamber air passage. A first pressure sealing grid is positioned outside of the first portion of the e-liquid medium, and a second pressure sealing grid is positioned outside of the third portion of the e-liquid medium. Each of the first pressure sealing grid and the second pressure sealing grid is configured to keep the first portion of the e-liquid medium, the first heating element, the second portion of the e-liquid medium, the second heating element, and the third portion of the e-liquid medium in close contact.

In certain embodiments, the heating assembly also includes an electric connector assembly. The electric connector assembly includes: an electric connector base, an electrode, and an insulation cover. The electric connector base attaches to a lower end of the heating element base and adapted for connecting an electric power supply to the vaporizer heating assembly. The electric connector base has an outer thread configured to electrically connect a first terminal of the electric power supply to the first terminal of the heating elements. The electrode is used to connect a second terminal of the electric power supply to the second terminal of the heating elements. The insulation cover is positioned between the electric connector base and the electrode to provide insulation between the first and the second terminals of the electric power supply.

In certain embodiments, the heating assembly further includes: a vapor tube and a vaporizing chamber top cover. The vapor tube is used to provide vapor to a user. The vaporizing chamber top cover is coupled to the vapor tube to guide the vapor to the user through the vapor tube. The vaporizing chamber top cover is positioned on the upper end of the vaporizing chamber, and the vapor tube is positioned on top of the vaporizing chamber top cover.

In another aspect, the present invention relates to an electronic cigarette. In certain embodiments, the electronic cigarette has a heating assembly. In certain embodiments, the heating assembly includes: a pair of vaporizer shields, certain heating elements, an e-liquid medium, a pair of vapor guides, and a vaporizing chamber side cover. The pair of vaporizer shields includes a first vaporizer shield on a first side, and a second vaporizer shield on an opposite, second side, disposed on a heating element base. An e-liquid medium opening is defined between the first vaporizer shield and the second vaporizer shield at both ends of the first vaporizer shield and the second vaporizer shield. Each of the heating elements has a first terminal and a second terminal. The e-liquid medium is vertically positioned in the e-liquid medium opening between the first vaporizer shield and the second vaporizer shield. The e-liquid medium has certain heating element grooves for installing the heating elements. The pair of vapor guides includes a first vapor guide positioned between the first vaporizer shield and the e-liquid medium, and a second vapor guide positioned between the second vaporizer shield and the e-liquid medium. The vaporizing chamber side cover is configured to surround the first vaporizer shield and the second vaporizer shield, the e-liquid medium. The vaporizing chamber side cover defines a first e-liquid conduit opening on a first side, adjacent to and in communication with a first end of the e-liquid medium, and a second e-liquid conduit opening on an opposite, second side, adjacent to and in communication with an opposite, second end of the e-liquid medium.

In certain embodiments, the first vaporizer shield and the second vaporizer shield form a round vaporizing chamber having a vaporizing chamber air intake at a lower end of the vaporizing chamber and a vaporizing chamber air discharge at an upper end of the vaporizing chamber, and each of the first vaporizer shield and the second vaporizer shield defines a vapor guide connecting opening.

In certain embodiments, each of the heating elements includes a heating wire. The heating has the first terminal for electrically connecting to the first terminal of the electric ire power supply, and the second terminal for electrically connecting to the second terminal of the electric power supply. The heating wire is wound into a flat surface in a shape of: a spiral, a parabolic spiral, a round, an oval, a polygon, a rectangle, and a square.

In certain embodiments, the heating assembly also includes an electric connector assembly. The electric connector assembly includes: an electric connector base, an electrode, and an insulation cover. The electric connector base attaches to a lower end of the heating element base and adapted for connecting an electric power supply to the vaporizer heating assembly. The electric connector base has an outer thread configured to electrically connect a first terminal of the electric power supply to the first terminal of the heating elements. The electrode is used to connect a second terminal of the electric power supply to the second terminal of the heating elements. The insulation cover is positioned between the electric connector base and the electrode to provide insulation between the first and the second terminals of the electric power supply.

In certain embodiments, the heating assembly further includes: a vapor tube and a vaporizing chamber top cover. The vapor tube is used to provide vapor to a user. The vaporizing chamber top cover is coupled to the vapor tube to guide the vapor to the user through the vapor tube. The vaporizing chamber top cover is positioned on the upper end of the vaporizing chamber, and the vapor tube is positioned on top of the vaporizing chamber top cover.

These and other aspects of the present invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment. The drawings do not limit the present invention to the specific embodiments disclosed and described herein. The drawings are not necessarily to scale, emphasis instead being placed upon clearly illustrating the principles of the invention, and wherein.

DETAILED DESCRIPTION

Figure 1:
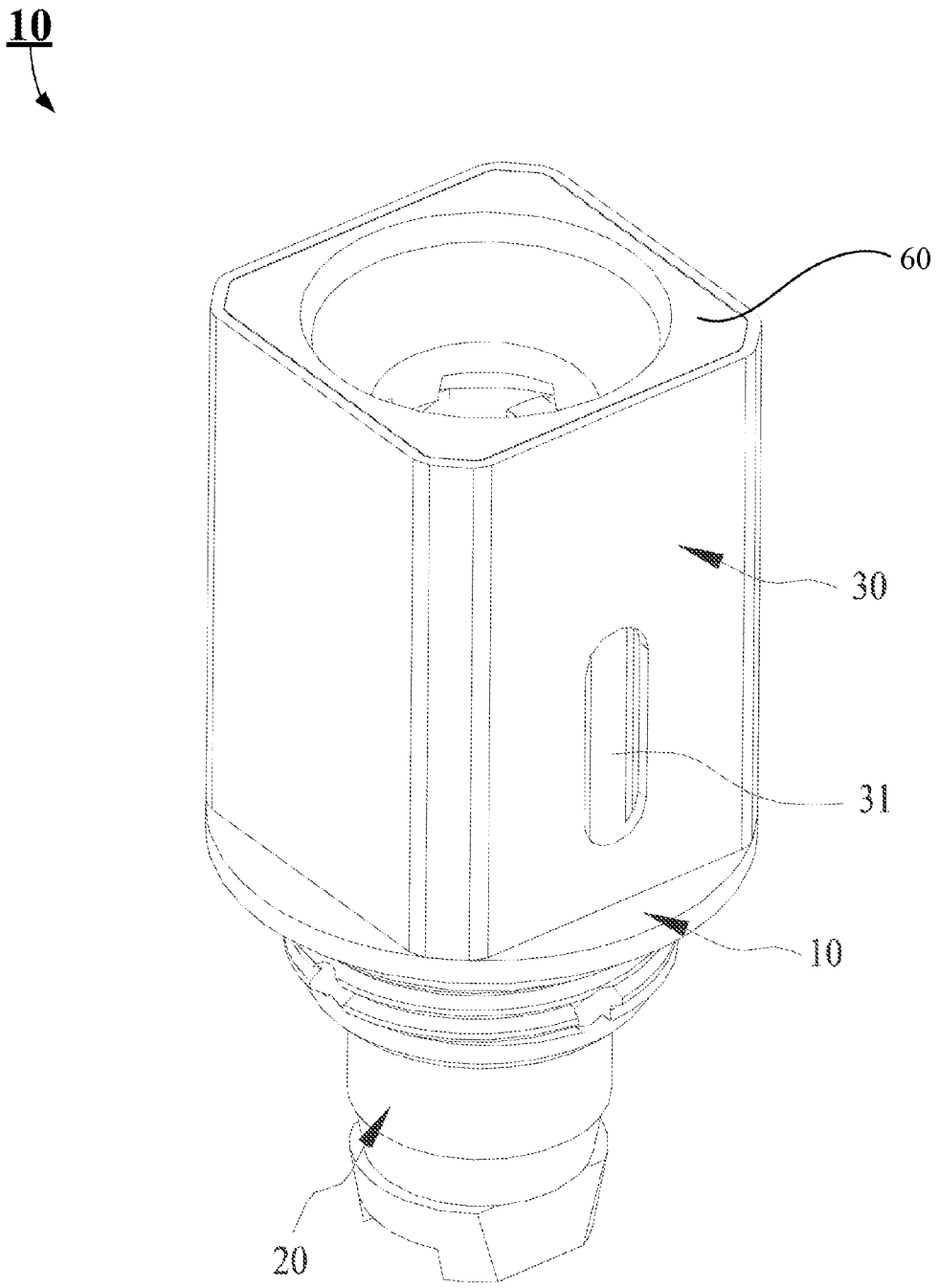
FIG. 1 is a perspective view of a heating assembly for electronic cigarette vaporizer according to certain embodiments of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present invention be fully understood, but the present invention may also be implemented by using other manners different from those described herein, so that the present invention is not limited by the specific embodiments disclosed in the following.

Figure 2:
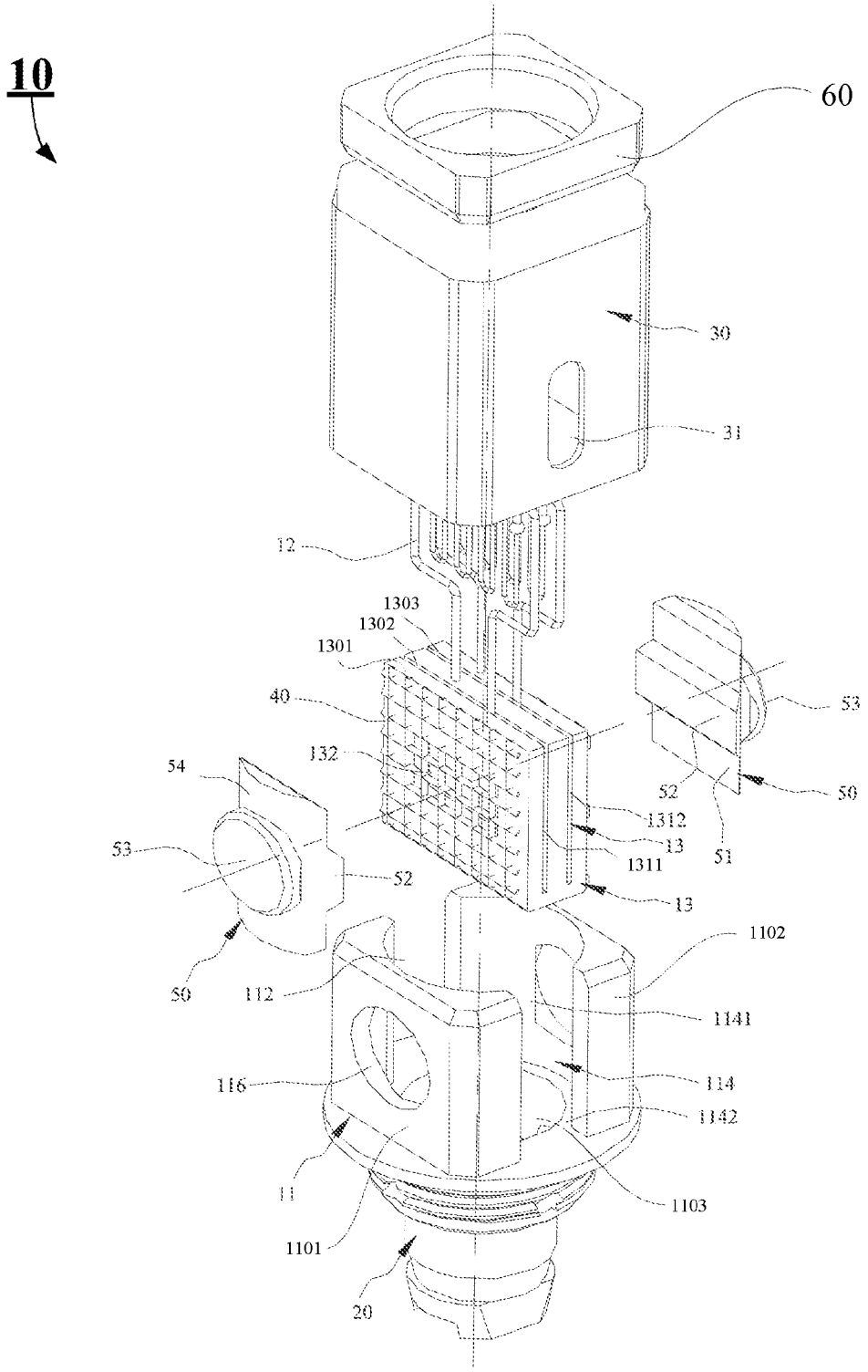
FIG. 2 shows an exploded perspective view of the heating assembly for electronic cigarette vaporizer according to certain embodiments of the present invention.
Figure 3:
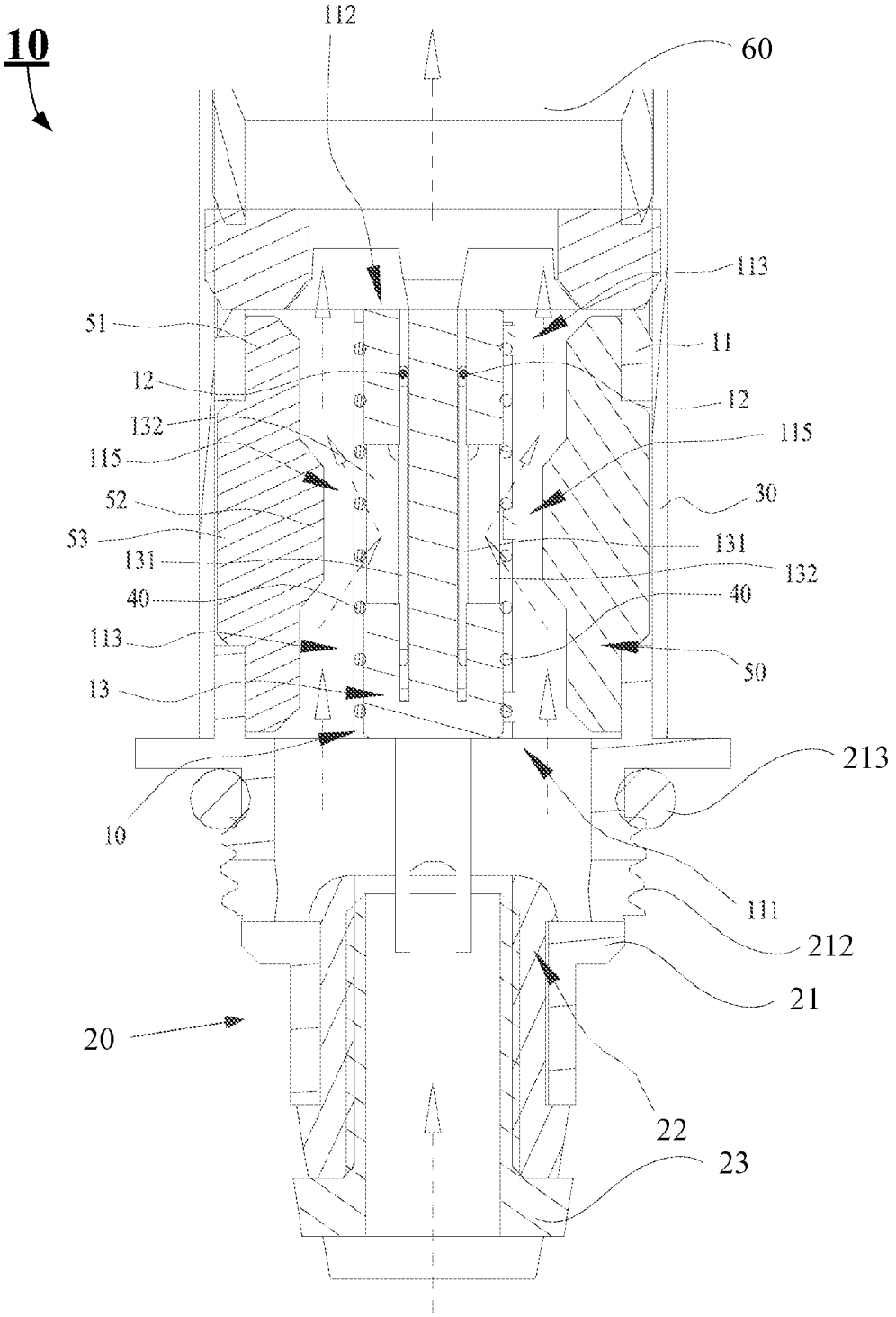
FIG. 3 shows a cross sectional view of the heating assembly for electronic cigarette vaporizer showing air flow according to certain embodiments of the present invention.

The description will be made as to the embodiments of the present invention in conjunction with the accompanying drawings FIGS. 1 through 5. In accordance with the purposes of this invention, as embodied and broadly described herein, this invention, in one aspect, relates to a heating assembly 10 for electronic cigarette (e-cigarette) vaporizer. In certain embodiments, as shown in FIGS. 1-3, the heating assembly 10 includes: a first vaporizer shield 1101, a second vaporizer shield 1102, a first heating element 12, a second heating element 12, an e-liquid medium 13, a first vapor guide 50, a second vapor guide 50, and a vaporizing chamber side cover 30. The first vaporizer shield 1101 and the second vaporizer shield 1102 are positioned on a heating element base 11. In one embodiment, as shown in FIGS. 1 and 2, the heating element base 11 is circular. In other embodiments, the heating element base 11 can be any shapes, such as oval, rectangular, square, and other polygon shapes. The first vaporizer shield 1101 is positioned on a first side of the heating element base 11, and the second vaporizer shield 1102 is positioned on an opposite, second side of the heating element base 11. The heating element base 11 defines a center air vent opening 1103. An e-liquid medium opening 114 is defined between the first vaporizer shield 1101 and the second vaporizer shield 1102 at both ends of the first vaporizer shield 1101 and the second vaporizer shield 1102. The e-liquid medium opening 114 has an upper end 1141 at the vaporizing chamber air discharge 112 and a lower end 1142 at the vaporizing chamber air intake 111. The e-liquid medium 13 is vertically positioned in the e-liquid medium opening 114 between the first vaporizer shield 1101 and the second vaporizer shield 1102. Each of the first and the second heating elements 12 has a first terminal and a second terminal. The e-liquid medium 13 has certain heating element grooves 131 for installing the first and the second heating elements 12. The first vapor guide 50 is positioned between the first vaporizer shield 1101 and the e-liquid medium 13, and the second vapor guide 50 is positioned between the second vaporizer shield 1102 and the e-liquid medium 13. The vaporizing chamber side cover 30 is configured to surround the first vaporizer shield 1101 and the second vaporizer shield 1102, the e-liquid medium 13. The vaporizing chamber side cover 30 defines a first e-liquid conduit opening 31 on a first side, adjacent to and in communication with a first end of the e-liquid medium 13, and a second e-liquid conduit opening 31 on an opposite, second side, adjacent to and in communication with an opposite, second end of the e-liquid medium 13. When a user fills e-liquid in a storage tank (not shown in the drawings) of an electronic cigarette, the e-liquid in the storage tank flows through the first e-liquid conduit opening 31 into the first side of the e-liquid medium 13, and the second e-liquid conduit opening 31 into the second side of the e-liquid medium 13. The e-liquid medium 13 is soaked with e-liquid for vaporization when the user turns on the electric power supply.

In certain embodiments, the first vaporizer shield 1101 and the second vaporizer shield 1102 form a round vaporizing chamber having a vaporizing chamber air intake 111 at the center air vent opening 1103 of the heating element base 11 and a vaporizing chamber air discharge 112 at an upper end of the vaporizing chamber, and each of the first vaporizer shield 1101 and the second vaporizer shield 1102 defines a vapor guide connecting opening 116.

In certain embodiments, the outer perimeter of the first vaporizer shield 1101 and the second vaporizer shield 1102 is substantially square to fit inside of the vaporizing chamber side cover 30.

In certain embodiments, the e-liquid medium 13 includes two heating element grooves 131: a first heating element groove 1311 for installing the first heating element 12, and the second heating element groove 1312 for installing a second heating element 12. The e-liquid medium 13 is divided into three portions: a first portion 1301 defined between a first side of the e-liquid medium 13 and the first heating element groove 1311, a second portion defined between the first heating element groove 1311 and the second heating element groove 1312, and a third portion defined between the second heating element groove 1312 and a second side of the e-liquid medium 13. Each of the first portion of the e-liquid medium 13 and the third portion of the e-liquid medium 13 includes a vaporizing window 132 configured to expose vaporized e-liquid to a vapor chamber air passage 113. A first pressure sealing grid 40 is positioned outside of the first portion of the e-liquid medium 13, and a second pressure sealing grid 40 is positioned outside of the third portion of the e-liquid medium 13. Each of the first pressure sealing grid 40 and the second pressure sealing grid 40 is configured to keep the first portion of the e-liquid medium 13, the first heating element 12, the second portion of the e-liquid medium 13, the second heating element 12, and the third portion of the e-liquid medium 13 in close contact.

In certain embodiments, the e-liquid medium 13 includes one of following materials: cotton fibers, polypropylene fibers, terylene fibers, nylon fibers, and various porous ceramic materials. When cotton fibers and nylon fibers are heated up by the heating elements 12, it may produce certain burning smell. When the e-liquid medium 13 is made of various porous ceramic materials, the burning smell is eliminated. Therefore the user experiences are greatly enhanced.

In certain embodiments, the first pressure sealing grid 40, the first portion 1301 of the e-liquid medium 13, the first heating element 12, the second portion 1302 of the e-liquid medium 13, the second heating element 12, the third portion 1303 of the e-liquid medium 13, and the second pressure sealing grid 40 are assembled together and further inserted into the e-liquid medium opening 114 on the heating element base 11. The insertion of this assembly divides the vaporizing chamber into two air passages 115 as shown in FIG. 3, one on each side of the e-liquid medium 13.

In certain embodiments, the first vapor guide 50 has a round portion 54 on a first side fitting to the round vaporizing chamber, and a straight portion 51 on an opposite side facing the e-liquid medium 13, and the second vapor guide 50 has a round portion 54 on a first side fitting to the round portion of the vaporizing chamber, and a straight portion 51 on an opposite side facing the e-liquid medium 13. The round portion 54 of the first vapor guide 50 has a first vapor guide connector 53 configured to connect to the vapor guide connecting opening 116 of the first vaporizer shield 1101. The round portion 54 of the second vapor guide 50 also has a second vapor guide connector 53 configured to connect to the vapor guide connecting opening 116 of the second vaporizer shield 1102. The straight portion 51 of each of the first and the second vapor guides 50 has a vapor guide bulge 52 which is configured to deflect and guide the air from the vaporizing chamber air intake 111 to the e-liquid medium 13.

In certain embodiments, the first vapor guide connector 53 fits into the vapor guide connecting opening 116 of the first vaporizer shield 1101, and the second vapor guide connector 53 fits into the vapor guide connecting opening 116 of the second vaporizer shield 1102. The shapes of first vapor guide connector 53 and the second vapor guide connector 53 include: a round shape, an oval shape, a square shape, a rectangle shape, and a polygon shape. Each of the first e-liquid conduit opening 31 and the second e-liquid conduit opening 31 is substantially in the shape and size of the e-liquid medium opening 114 configured to fully expose e-liquid from an e-liquid storage to flow into the e-liquid medium 13.

In certain embodiments, when the first pressure sealing grid 40, the first portion 1301 of the e-liquid medium 13, the first heating element 12, the second portion 1302 of the e-liquid medium 13, the second heating element 12, the third portion 1303 of the e-liquid medium 13, and the second pressure sealing grid 40 are assembled together and inserted into the e-liquid medium opening 114 on the heating element base 11, and the first vapor guide connector 53 is placed in the vapor guide connecting opening 116 of the first vaporizer shield 1101, and the second vapor guide connector 53 is placed in the vapor guide connecting opening 116 of the second vaporizer shield 1102, the heating assembly 10 is assembled. The vaporizing chamber side cover 30 is then placed outside of the heating assembly 10.

Figure 4:
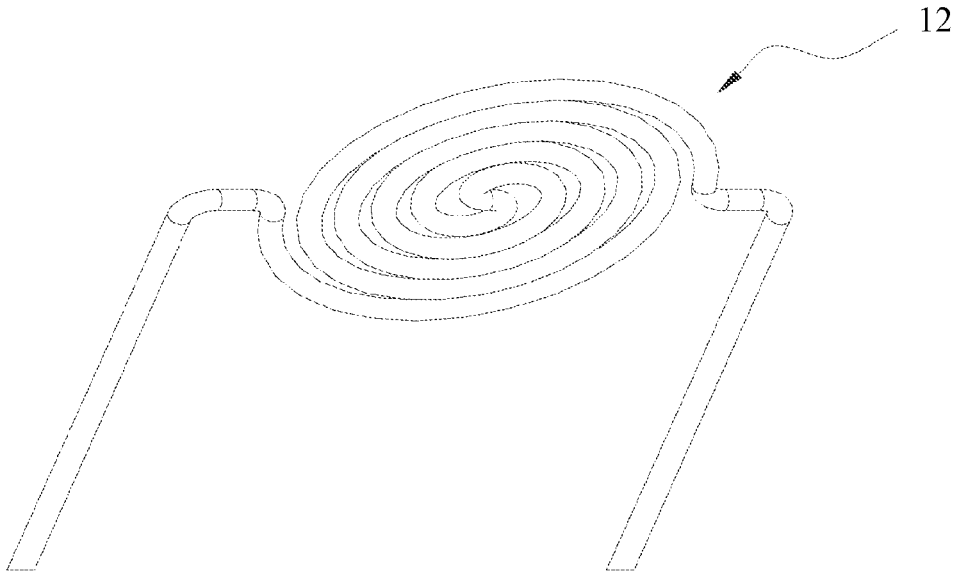
FIG. 4 shows a perspective view of a heating element in a parabolic spiral shape according to certain embodiments of the present invention.
Figure 5:
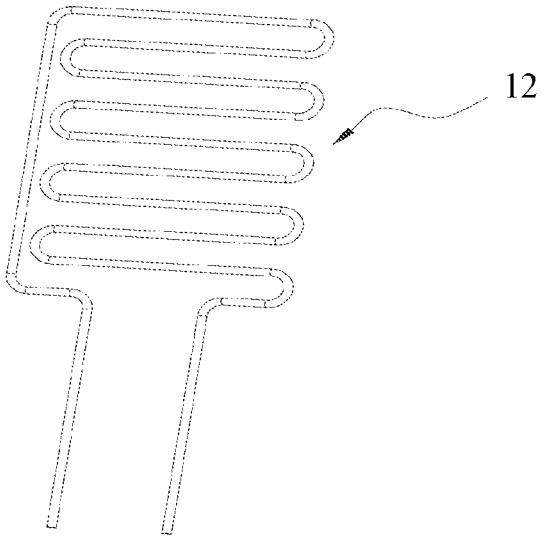
FIG. 5 shows a perspective view of another heating element in a rectangular shape according to certain embodiments of the present invention.

Referring to FIGS. 4-5, in certain embodiments, the each of the first heating element 12 and the second heating element 12 has a heating wire. The heating wire has the first terminal to be connected to the first terminal of an electric power supply, and the second terminal to be connected to the second terminal of the electric power supply. The heating wire of the heating element 12 is wound to form a flat surface. The flat surface may be in one of following shapes: a spiral shape, a parabolic spiral shape, a rectangle shape, a square shape, a round shape, a polygon shape, and an oval shape.

In one embodiment as shown in FIG. 4, the heating wire of the heating element 12 is arranged in a parabolic spiral shape having the first terminal and the second terminal on each side of the heating element 12.

In another embodiment as shown in FIG. 5, the heating wire of the heating element 12 is arranged in a rectangular shape having the first terminal and the second terminal at the bottom of the heating element 12.

In certain embodiments, each of the heating elements 12 includes a heating wire. The heating has the first terminal for electrically connecting to the first terminal of the electric ire power supply, and the second terminal for electrically connecting to the second terminal of the electric power supply. The heating wire is wound into a flat surface in a shape of: a spiral, a parabolic spiral, a round, an oval, a polygon, a rectangle, and a square. When the heating elements 12 are arranged in a flat surface, instead of one or two straight wires, the heating surface is greatly increased, causing better vaporization of e-liquid and producing more e-liquid vapor.

In certain embodiments, the heating assembly 10 also includes an electric connector assembly 20. The electric connector assembly 20 includes: an electric connector base 21, an electric connector base 21, and an electric connector base 21. The electric connector base 21 attaches to a lower end of the heating element base 11 and adapted for connecting an electric power supply to the vaporizer heating assembly 10. The electric connector base 21 has an outer thread 212 configured to electrically connect a first terminal of the electric power supply to the first terminal of the heating elements 12. The electrode 23 is used to connect a second terminal of the electric power supply to the second terminal of the heating elements 12. The insulation cover 22 is positioned between the electric connector base 21 and the electrode 23 to provide insulation between the first and the second terminals of the electric power supply. An electric power supply switch may be used between the electric connector assembly 20 and the first and the second terminals of the heating elements 12 such that the user can turn on or off the electric cigarette as the user desires.

In certain embodiments, the heating assembly 10 further includes: a vapor tube (not shown in FIGS. 1-5) and a vaporizing chamber top cover 60. The vapor tube is used to provide vapor to a user. The vaporizing chamber top cover 60 is coupled to the vapor tube to guide the vapor to the user through the vapor tube. The vaporizing chamber top cover 60 is positioned on the upper end of the vaporizing chamber, and the vapor tube is positioned on top of the vaporizing chamber top cover 60.

In another aspect, the present invention relates to an electronic cigarette. In certain embodiments, the electronic cigarette has a heating assembly 10. As shown in FIGS. 1-3, the heating assembly 10 includes: a first vaporizer shield 1101, a second vaporizer shield 1102, a first heating element 12, a second heating element 12, an e-liquid medium 13, a first vapor guide 50, a second vapor guide 50, and a vaporizing chamber side cover 30. The first vaporizer shield 1101 and the second vaporizer shield 1102 are positioned on a heating element base 11. In one embodiment, as shown in FIGS. 1 and 2, the heating element base 11 is circular. In other embodiments, the heating element base 11 can be any shapes, such as oval, rectangular, square, and other polygon shapes. The first vaporizer shield 1101 is positioned on a first side of the heating element base 11, and the second vaporizer shield 1102 is positioned on an opposite, second side of the heating element base 11. The heating element base 11 defines a center air vent opening 1103. An e-liquid medium opening 114 is defined between the first vaporizer shield 1101 and the second vaporizer shield 1102 at both ends of the first vaporizer shield 1101 and the second vaporizer shield 1102. The e-liquid medium opening 114 has an upper end 1141 at the vaporizing chamber air discharge 112 and a lower end 1142 at the vaporizing chamber air intake 111. The e-liquid medium 13 is vertically positioned in the e-liquid medium opening 114 between the first vaporizer shield 1101 and the second vaporizer shield 1102. Each of the first and the second heating elements 12 has a first terminal and a second terminal. The e-liquid medium 13 has certain heating element grooves 131 for installing the first and the second heating elements 12. The first vapor guide 50 is positioned between the first vaporizer shield 1101 and the e-liquid medium 13, and the second vapor guide 50 is positioned between the second vaporizer shield 1102 and the e-liquid medium 13. The vaporizing chamber side cover 30 is configured to surround the first vaporizer shield 1101 and the second vaporizer shield 1102, the e-liquid medium 13. The vaporizing chamber side cover 30 defines a first e-liquid conduit opening 31 on a first side, adjacent to and in communication with a first end of the e-liquid medium 13, and a second e-liquid conduit opening 31 on an opposite, second side, adjacent to and in communication with an opposite, second end of the e-liquid medium 13. When a user fills e-liquid in a storage tank (not shown in the drawings) of an electronic cigarette, the e-liquid in the storage tank flows through the first e-liquid conduit opening 31 into the first side of the e-liquid medium 13, and the second e-liquid conduit opening 31 into the second side of the e-liquid medium 13. The e-liquid medium 13 is soaked with e-liquid for vaporization when the user turns on the electric power supply.

In certain embodiments, the first vaporizer shield 1101 and the second vaporizer shield 1102 form a round vaporizing chamber having a vaporizing chamber air intake 111 at the center air vent opening 1103 of the heating element base 11 and a vaporizing chamber air discharge 112 at an upper end of the vaporizing chamber, and each of the first vaporizer shield 1101 and the second vaporizer shield 1102 defines a vapor guide connecting opening 116.

In certain embodiments, the outer perimeter of the first vaporizer shield 1101 and the second vaporizer shield 1102 is substantially square to fit inside of the vaporizing chamber side cover 30.

In certain embodiments, the e-liquid medium 13 includes two heating element grooves 131: a first heating element groove 1311 for installing the first heating element 12, and the second heating element groove 1312 for installing a second heating element 12. The e-liquid medium 13 is divided into three portions: a first portion 1301 defined between a first side of the e-liquid medium 13 and the first heating element groove 1311, a second portion defined between the first heating element groove 1311 and the second heating element groove 1312, and a third portion defined between the second heating element groove 1312 and a second side of the e-liquid medium 13. Each of the first portion of the e-liquid medium 13 and the third portion of the e-liquid medium 13 includes a vaporizing window 132 configured to expose vaporized e-liquid to a vapor chamber air passage 113. A first pressure sealing grid 40 is positioned outside of the first portion of the e-liquid medium 13, and a second pressure sealing grid 40 is positioned outside of the third portion of the e-liquid medium 13. Each of the first pressure sealing grid 40 and the second pressure sealing grid 40 is configured to keep the first portion of the e-liquid medium 13, the first heating element 12, the second portion of the e-liquid medium 13, the second heating element 12, and the third portion of the e-liquid medium 13 in close contact.

In certain embodiments, the e-liquid medium 13 includes one of following materials: cotton fibers, polypropylene fibers, terylene fibers, nylon fibers, and various porous ceramic materials.

In certain embodiments, the first pressure sealing grid 40, the first portion 1301 of the e-liquid medium 13, the first heating element 12, the second portion 1302 of the e-liquid medium 13, the second heating element 12, the third portion 1303 of the e-liquid medium 13, and the second pressure sealing grid 40 are assembled together and further inserted into the e-liquid medium opening 114 on the heating element base 11. The insertion of this assembly divides the vaporizing chamber into two air passages 115 as shown in FIG. 3, one on each side of the e-liquid medium 13.

In certain embodiments, the first vapor guide 50 has a round portion 54 on a first side fitting to the round vaporizing chamber, and a straight portion 51 on an opposite side facing the e-liquid medium 13, and the second vapor guide 50 has a round portion 54 on a first side fitting to the round portion of the vaporizing chamber, and a straight portion 51 on an opposite side facing the e-liquid medium 13. The round portion 54 of the first vapor guide 50 has a first vapor guide connector 53 configured to connect to the vapor guide connecting opening 116 of the first vaporizer shield 1101. The round portion 54 of the second vapor guide 50 also has a second vapor guide connector 53 configured to connect to the vapor guide connecting opening 116 of the second vaporizer shield 1102. The straight portion 51 of each of the first and the second vapor guides 50 has a vapor guide bulge 52 which is configured to deflect and guide the air from the vaporizing chamber air intake 111 to the e-liquid medium 13.

In certain embodiments, the first vapor guide connector 53 fits into the vapor guide connecting opening 116 of the first vaporizer shield 1101, and the second vapor guide connector 53 fits into the vapor guide connecting opening 116 of the second vaporizer shield 1102. The shapes of first vapor guide connector 53 and the second vapor guide connector 53 include: a round shape, an oval shape, a square shape, a rectangle shape, and a polygon shape. Each of the first e-liquid conduit opening 31 and the second e-liquid conduit opening 31 is substantially in the shape and size of the e-liquid medium opening 114 configured to fully expose e-liquid from an e-liquid storage to flow into the e-liquid medium 13.

In certain embodiments, when the first pressure sealing grid 40, the first portion 1301 of the e-liquid medium 13, the first heating element 12, the second portion 1302 of the e-liquid medium 13, the second heating element 12, the third portion 1303 of the e-liquid medium 13, and the second pressure sealing grid 40 are assembled together and inserted into the e-liquid medium opening 114 on the heating element base 11, and the first vapor guide connector 53 is placed in the vapor guide connecting opening 116 of the first vaporizer shield 1101, and the second vapor guide connector 53 is placed in the vapor guide connecting opening 116 of the second vaporizer shield 1102, the heating assembly 10 is assembled. The vaporizing chamber side cover 30 is then placed outside of the heating assembly 10.

Referring to FIGS. 4-5, in certain embodiments, the each of the first heating element 12 and the second heating element 12 has a heating wire. The heating wire has the first terminal to be connected to the first terminal of an electric power supply, and the second terminal to be connected to the second terminal of the electric power supply. The heating wire of the heating element 12 is wound to form a flat surface. The flat surface may be in one of following shapes: a spiral shape, a parabolic spiral shape, a rectangle shape, a square shape, a round shape, a polygon shape, and an oval shape.

In one embodiment as shown in FIG. 4, the heating wire of the heating element 12 is arranged in a parabolic spiral shape having the first terminal and the second terminal on each side of the heating element 12.

In another embodiment as shown in FIG. 5, the heating wire of the heating element 12 is arranged in a rectangular shape having the first terminal and the second terminal at the bottom of the heating element 12.

In certain embodiments, each of the heating elements 12 includes a heating wire. The heating has the first terminal for electrically connecting to the first terminal of the electric ire power supply, and the second terminal for electrically connecting to the second terminal of the electric power supply. The heating wire is wound into a flat surface in a shape of: a spiral, a parabolic spiral, a round, an oval, a polygon, a rectangle, and a square.

In certain embodiments, the heating assembly 10 also includes an electric connector assembly 20. The electric connector assembly 20 includes: an electric connector base 21, an electric connector base 21, and an electric connector base 21. The electric connector base 21 attaches to a lower end of the heating element base 11 and adapted for connecting an electric power supply to the vaporizer heating assembly 10. The electric connector base 21 has an outer thread 212 configured to electrically connect a first terminal of the electric power supply to the first terminal of the heating elements 12. The electrode 23 is used to connect a second terminal of the electric power supply to the second terminal of the heating elements 12. The insulation cover 22 is positioned between the electric connector base 21 and the electrode 23 to provide insulation between the first and the second terminals of the electric power supply.

In certain embodiments, the heating assembly 10 further includes: a vapor tube (not shown in FIGS. 1-5) and a vaporizing chamber top cover 60. The vapor tube is used to provide vapor to a user. The vaporizing chamber top cover 60 is coupled to the vapor tube to guide the vapor to the user through the vapor tube. The vaporizing chamber top cover 60 is positioned on the upper end of the vaporizing chamber, and the vapor tube is positioned on top of the vaporizing chamber top cover 60.

Referring back to FIG. 3, a cross sectional view of the heating assembly 10 for electronic cigarette vaporizer is shown according to certain embodiments of the present invention. When the user turns on the electric power supply, the heating elements 12 heats up e-liquid socked in the e-liquid medium 13 to generate e-liquid vapor near the vaporizing window 132. When the user sucks a mouthpiece connected to the vapor tuber (not shown in FIG. 3), the air flows in from the bottom of the heating assembly 10 through a hollow structure of the electrode 23, to the vaporizing chamber air intake 111, up along the two air passages 115 of the vaporizing chamber, one on each side of the e-liquid medium 13. The air is deflected by the vapor guide bulges 52 and directed to the vaporizing windows 132 of the first portion 1301 and the third portion 1303. The e-liquid vapor generated at the heating elements 12 goes out to the user through the vaporizing chamber air discharge 112 and the vaporizing chamber top cover 60.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims, the foregoing description and the exemplary embodiments described therein, and accompanying drawings.

What is claimed is:

1. A heating assembly for electronic cigarette vaporizer, comprising:

a first vaporizer shield on a first side, and a second vaporizer shield on an opposite, second side, disposed on a heating element base, wherein an e-liquid medium opening is defined between the first vaporizer shield and the second vaporizer shield at both ends of the first vaporizer shield and the second vaporizer shield;

a plurality of heating elements, wherein each of the plurality of heating elements has a first terminal and a second terminal;

an e-liquid medium vertically positioned in the e-liquid medium opening between the first vaporizer shield and the second vaporizer shield, wherein the e-liquid medium comprises a plurality of heating element grooves for installing the plurality of the heating elements;

a first vapor guide positioned between the first vaporizer shield and the e-liquid medium, and a second vapor guide positioned between the second vaporizer shield and the e-liquid medium; and a vaporizing chamber side cover configured to surround the first vaporizer shield and the second vaporizer shield, the e-liquid medium, wherein the vaporizing chamber side cover defines a first e-liquid conduit opening on a first side, adjacent to and in communication with a first end of the e-liquid medium, a second e-liquid conduit opening on an opposite, second side, adjacent to and in communication with an opposite, second end of the e-liquid medium.

2. The heating assembly of claim 1, wherein the first vaporizer shield and the second vaporizer shield form a round vaporizing chamber having a vaporizing chamber air intake at a lower end of the vaporizing chamber and a vaporizing chamber air discharge at an upper end of the vaporizing chamber, and each of the first vaporizer shield and the second vaporizer shield defines a vapor guide connecting opening.

3. The heating assembly of claim 2, wherein the e-liquid medium opening comprises an upper end at the vaporizing chamber air discharge and a lower end at the vaporizing chamber air intake.

4. The heating assembly of claim 2, wherein the outer perimeter of the first vaporizer shield and the second vaporizer shield is substantially square to fit inside of the vaporizing chamber side cover.

5. The heating assembly of claim 4, wherein the first vapor guide comprises a round portion on a first side fitting to the round vaporizing chamber, and a straight portion on an opposite side facing the e-liquid medium, and the second vapor guide comprises a round portion on a first side fitting to the round portion of the vaporizing chamber, and a straight portion on an opposite side facing the e-liquid medium, the round portion of the first vapor guide comprises a first vapor guide connector configured to connect to the vapor guide connecting opening of the first vaporizer shield, the round portion of the second vapor guide comprises a second vapor guide connector configured to connect to the vapor guide connecting opening of the second vaporizer shield, and the straight portion of each of the first vapor guide and the second vapor guide comprises a vapor guide bulge configured to deflect the air from the vaporizing chamber air intake to the e-liquid medium.

6. The heating assembly of claim 5, wherein the first vapor guide connector fits into the vapor guide connecting opening of the first vaporizer shield, and the second vapor guide connector fits into the vapor guide connecting opening of the second vaporizer shield.

7. The heating assembly of claim 6, wherein the shapes of first vapor guide connector and the second vapor guide connector comprise: a round, an oval, a square, a rectangle, and a polygon.

8. The heating assembly of claim 1, wherein each of the first e-liquid conduit opening and the second e-liquid conduit opening is in the shape and size of the e-liquid medium opening configured to fully expose e-liquid from an e-liquid storage to flow into the e-liquid medium.

9. The heating assembly of claim 1, wherein each of the plurality of heating elements comprises a heating wire having the first terminal for electrically connecting to a first terminal of an electric power supply, and the second terminal for electrically connecting to a second terminal of the electric power supply, and winding into a flat surface in a shape comprising:

a spiral;
a parabolic spiral;
a round;
an oval;
a polygon;
a rectangle; and
a square.

10. The heating assembly of claim 1, wherein the e-liquid medium comprises:

cotton fibers;

polypropylene fibers;
terylene fibers;
nylon fibers; and
porous ceramic materials.

11. The heating assembly of claim 1, wherein the e-liquid medium comprises:

a first heating element groove for installing a first heating element; and a second heating element groove for installing a second heating element.

12. The heating assembly of claim 1, wherein the e-liquid medium comprises:

a first portion defined between a first side of the e-liquid medium and the first heating element groove;

a second portion defined between the first heating element groove and the second heating element groove; and a third portion defined between the second heating element groove and a second side of the e-liquid medium, wherein each of the first portion of the e-liquid medium and the third portion of the e-liquid medium comprises a vaporizing window configured to expose vaporized e-liquid to a vapor chamber air passage.

13. The heating assembly of claim 12, wherein a first pressure sealing grid is positioned outside of the first portion of the e-liquid medium, and a second pressure sealing grid is positioned outside of the third portion of the e-liquid medium, wherein each of the first pressure sealing grid and the second pressure sealing grid is configured to keep the first portion of the e-liquid medium, the plurality of heating elements, the second portion of the e-liquid medium, and the third portion of the e-liquid medium in close contact.

14. The heating assembly of claim 1, further comprising an electric connector assembly, wherein the electric connector assembly comprises:

an electric connector base attached to a lower end of the heating element base and adapted for connecting an electric power supply to the vaporizer heating assembly, wherein the electric connector base comprises an outer thread configured to electrically connect a first terminal of the electric power supply to the first terminal of the heating elements;

an electrode configured to electrically connect a second terminal of the electric power supply to the second terminal of the heating elements; and an insulation cover positioned between the electric connector base and the electrode to provide insulation between the first and the second terminals of the electric power supply.

15. The heating assembly of claim 1, further comprising:

a vapor tube adapted for providing vapor to a user; and a vaporizing chamber top cover coupled to the vapor tube to guide the vapor to the user through the vapor tube, a vaporizing chamber having a top cover wherein the top cover of the vaporizing chamber is positioned on the upper end of the vaporizing chamber, and the vapor tube is positioned on top of the vaporizing chamber top cover.

16. An electronic cigarette comprising a heating assembly, wherein the heating assembly comprises:

a first vaporizer shield on a first side, and a second vaporizer shield on an opposite, second side, disposed on a heating element base, wherein an e-liquid medium opening is defined between the first vaporizer shield and the second vaporizer shield at both ends of the first vaporizer shield and the second vaporizer shield;

a plurality of heating elements, wherein each of the plurality of heating elements has a first terminal and a second terminal;

an e-liquid medium vertically positioned in the e-liquid medium opening between the first vaporizer shield and the second vaporizer shield, wherein the e-liquid medium comprises a plurality of heating element grooves for installing the plurality of the heating elements;

a first vapor guide positioned between the first vaporizer shield and the e-liquid medium, and a second vapor guide positioned between the second vaporizer shield and the e-liquid medium; and a vaporizing chamber side cover configured to surround the first vaporizer shield and the second vaporizer shield, the e-liquid medium, wherein the vaporizing chamber side cover defines a first e-liquid conduit opening on a first side, adjacent to and in communication with a first end of the e-liquid medium, a second e-liquid conduit opening on an opposite, second side, adjacent to and in communication with an opposite, second end of the e-liquid medium.

17. The electronic cigarette of claim 16, wherein the first vaporizer shield and the second vaporizer shield form a round vaporizing chamber having a vaporizing chamber air intake at a lower end of the vaporizing chamber and a vaporizing chamber air discharge at an upper end of the vaporizing chamber, and each of the first vaporizer shield and the second vaporizer shield defines a vapor guide connecting opening.

18. The electronic cigarette of claim 16, wherein each of the plurality of heating elements comprises a heating wire having the first terminal for electrically connecting to a first terminal of an electric power supply, and the second terminal for electrically connecting to a second terminal of the electric power supply, and winding into a flat surface in a shape comprising:

a spiral;
a parabolic spiral;
a round;
an oval;
a polygon;
a rectangle; and
a square.

19. The electronic cigarette of claim 16, further comprising an electric connector assembly, wherein the electric connector assembly comprises:

an electric connector base attached to a lower end of the heating element base and adapted for connecting an electric power supply to the vaporizer heating assembly, wherein the electric connector base comprises an outer thread configured to electrically connect a first terminal of the electric power supply to the first terminal of the heating elements;

an electrode configured to electrically connect a second terminal of the electric power supply to the second terminal of the heating elements; and an insulation cover positioned between the electric connector base and the electrode to provide insulation between the first and the second terminals of the electric power supply.

20. The electronic cigarette of claim 16, further comprising:

a vapor tube adapted for providing vapor to a user; and a vaporizing chamber top cover coupled to the vapor tube to guide the vapor to the user through the vapor tube, a vaporizing chamber having a top cover wherein the top cover of the vaporizing chamber is positioned on the upper end of the vaporizing chamber, and the vapor tube is positioned on top of the vaporizing chamber top cover.

* * * * *